United States Patent [19]

Neel et al.

[11] Patent Number: 4,672,157

[45] Date of Patent: Jun. 9, 1987

[54] LOW VOLTAGE CIRCUIT BREAKER WITH IMPROVED BREAKING

[75] Inventors: Jean-Philippe Neel, Meylan; Jean-Pierre Trahin, Echirolles, both of France

[73] Assignee: Merlin Gerin, Grenoble, France

[21] Appl. No.: 870,527

[22] Filed: Jun. 4, 1986

[30] Foreign Application Priority Data

Jun. 12, 1985 [FR] France ..... 85 09002

[51] Int. Cl.[4] ..... H01H 33/06; H01H 33/08; H01H 33/12

[52] U.S. Cl. ..... 200/144 R; 200/147 R; 200/305; 200/306

[58] Field of Search..... 200/144 R, 147 R, 146 R, 200/305, 306

[56] References Cited

U.S. PATENT DOCUMENTS 2,839,641 6/1958 Edmunds ..... 200/144 R

FOREIGN PATENT DOCUMENTS 142404 5/1985 European Pat. No. .
1021054 12/1957 Fed. Rep. of Germany .
1926693 11/1970 Fed. Rep. of Germany .
2643433 6/1977 Fed. Rep. of Germany .
2484136 12/1981 France .

*Primary Examiner*—Robert S. Macon
*Attorney, Agent, or Firm*—Parkhurst & Oliff

[57] ABSTRACT

A moulded case low voltage circuit breaker for high currents has no arcing contacts and is equipped with arc blow-out means drawing the arc very quickly away from the contacts. An insulating shield associated with the moving contact forms an arc formation chamber of a small volume which is open in the direction of the arc chute. The moving and stationary contacts are fitted with arcing horns constituting a small divergent path in proximity to the contacts favoring rapid displacement of the arc, this divergent path leading to an area defined by a hump of the horn. In this area, the clearance of the arcing horns is smaller than the clearance between the contacts as soon as the latter separate to avoid any rearcing on these contacts.

7 Claims, 5 Drawing Figures

LOW VOLTAGE CIRCUIT BREAKER WITH IMPROVED BREAKING

BACKGROUND OF THE INVENTION

The invention relates to a moulded case low voltage multipole circuit breaker.

The increased powers installed require protective circuit breakers with greater performances, notably able to break short-circuit currents of very high intensity. The solutions proposed or implemented at the present time use complicated devices, such as arcing contacts or current flow circuits favouring an arc blow-out.

The object of the present invention is to enable a moulded case circuit breaker with improved breaking capacity to be achieved using particularly simple and efficient means.

SUMMARY OF THE INVENTION

The circuit breaker according to the invention is characterized by the fact that the contacts have associated with them means, which are active during a short initial period at the moment separation of said contacts occurs, of quickly blowing out the arc drawn from the contacts towards arcing horns adjacent to the contact surfaces, said horns then guiding the arc towards the arc chute.

Any stagnation of the arc on the contacts and any erosion of the latter due to the action of the arc are thus avoided. The arc leaves the contact area very quickly and is prevented from returning to this area, avoiding any risk of damage to the contacts, which act both as main contacts and as arcing contacts. Abolishing the arcing contacts reduces the contact area and simplifies the switchgear unit as a whole.

According to a first feature of the invention, an insulating shield is associated with the moving contacts, in such a way as to form with the stationary contacts an arc formation chamber opening onto the arc chute. The insulating shield notably blanks off the gaps between the different moving contacts, as well as the gap disposed between the insulating partitions bounding the compartments of the different poles and the adjacent moving contacts. The insulating shield is advantageously a single moulded part made of gas-producing material having slots for the contact arms to pass through. The central part of the insulating shield extends parallel to the stationary contacts a short distance from the latter to form an arc formation chamber of a small height. The limited volume of the arc formation chamber ensures a rapid pressure increase due to the thermal and gas-producing action of the arc. The compressed gases escape towards the arc chute blowing out the arc which leaves the contact area very quickly.

The initial fast displacement of the arc also results from a particular shaping of the arc migration paths constituted by arcing horns associated with the contacts. According to the present invention, the stationary arcing horn presents a hump having one side parallel to the direction of movement of the moving contact to define an area with a small clearance avoiding any rearcing on the contacts. The arcing horns define paths divergent from the contacts favouring the displacement of the arc which tends to be stretched. The stationary arcing horn is preferably made of stainless steel or refractory material and extends into the arc chute constituting one of the end plates of the latter.

The hump of the stationary arcing horn limits the initial lengthening of the arc in the area in proximity to the contacts.

The combined action of the insulating shield and of the arcing horns makes it possible to produce a circuit breaker with a simplified active part. The contact fingers are simple copper blades articulated on a common spindle borne by a moving contact support. The moving contact is constituted by a pad fitted on one of the longitudinal edges of the blade which in conjunction with the front edge forms the moving arcing horn.

The arc chute comprises deionization plates and according to an embodiment of the invention, the back of this chute is blanked off by a valve acting as a deflector of the gases escaping from the arc chute. The valve opens automatically when a high pressure rise occurs inside the arc chute, the gases flowing out through a baffle system. The valve makes it possible to control the pressure inside the arc chute and to ensure that the arc is blown out independently from its intensity. The valve is advantageously constituted by an insulating plate made of a gas-producing material, the side walls of the arc chute also being possibly made of gas-producing material.

BRIEF DESCRIPTION OF THE DRAWINGS

Other advantages and characteristics will become more clearly apparent from the following description of different embodiments of the invention, given as examples only and represented by the accompanying drawings, in which.

DESCRIPTION OF THE PREFERRED EMBODIMENTS

Figure 1:
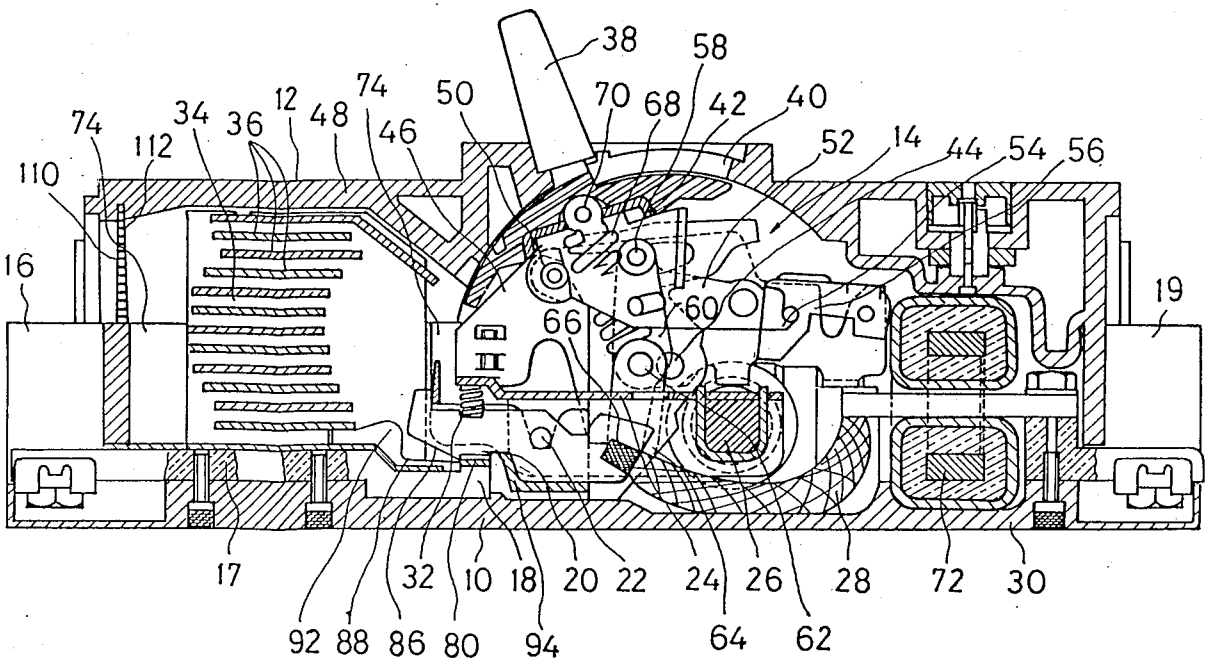
FIG. 1 is a longitudinal sectional view of a circuit breaker according to the invention, represented in the closed position.
Figures 2, 5:
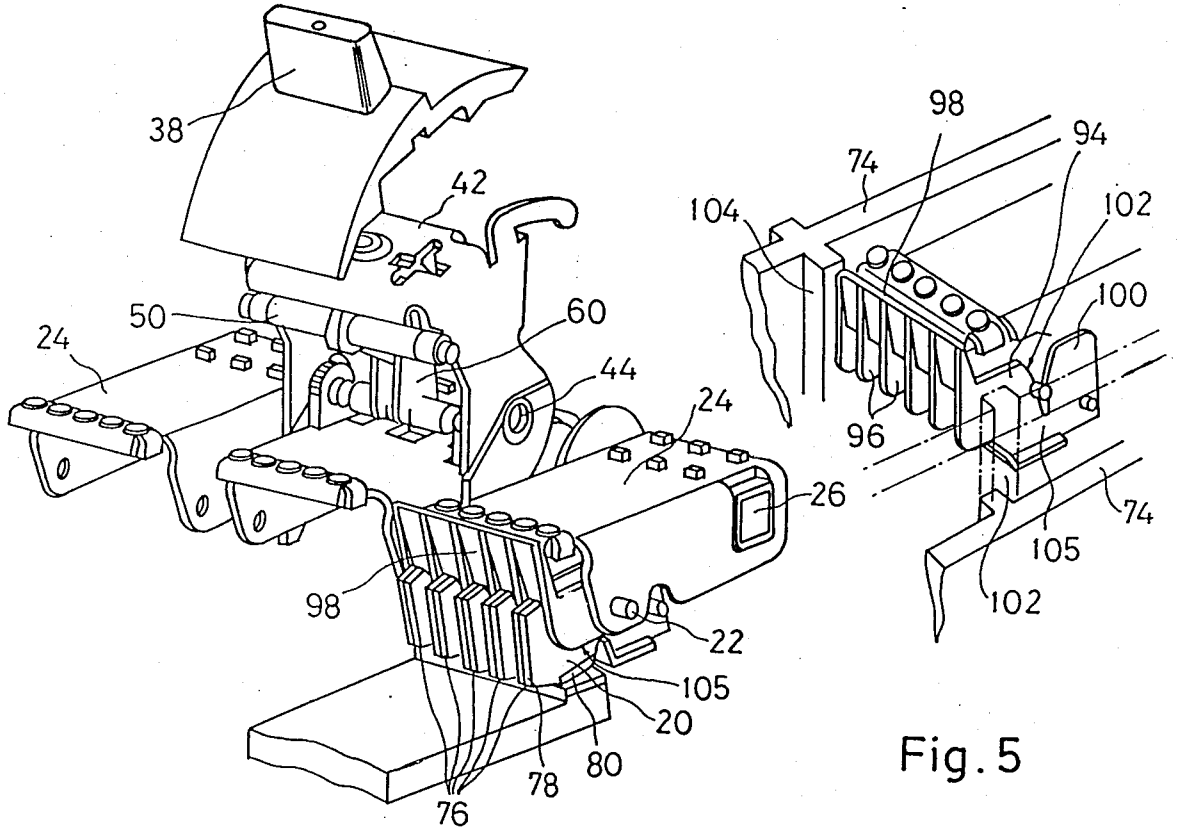
FIG. 2 is a schematic perspective view of the moving assembly according to FIG. 1.
FIG. 5 is a schematic perspective view of the insulating shield.

In the figures, a low voltage electrical circuit breaker comprises a moulded case having a base 10 and a cover 12 in which an operating mechanism indicated by the general reference 14 is housed. The electrical part of the circuit breaker comprises input 16 and output 19 terminals, the input termina1 16 being connected to a stationary contact 18 by a conductor 17, running flat along the base 10 of the moulded case. The stationary contact 18 has cooperating with it moving contacts 20, pivotally mounted on a spindle 22 borne by a contact support 24, securedly united with a connecting bar 26 between the different poles of the circuit breaker. The moving contacts 20 are connected by braids 28 to a conductor 30 fixed to the output terminal 19. The conductor 30 constitutes the primary winding of a current transformer 72 in the form of a toroid. Springs 32, fitted between the support 24 and the moving contacts 20, ensure the contact pressure. The contacts 18, 20 have associated with them an arc chute 34 fitted with deionization plates 36.

The mechanism 14 comprises a handle 38 which passes through an opening 40 in the cover 12 and is rigidly fastened to a support 42, pivotally mounted on a fixed spindle 44 supported by flange-plates 46, fixed to the moulded case by means of screws 48. A second fixed spindle 50 has articulated on it a hook 52, the end 54 of which cooperates with a latching device 56. On a spindle 58 of the hook 52, is articulated an upper rod 60 of a toggle-joint spindle 62. The lower rod 64 of the toggle-joint is articulated on a spindle 66 borne by the support 24. A tension spring 68 is anchored on the one hand to the toggle-joint spindle 62 and on the other hand to a spindle 70 borne by the support 42 of the handle 38. A circuit breaker of this kind is well-known and is described in detail in the Patent application filed concurrently. Manual opening of the circuit breaker is controlled by pivoting of the handle 38 which causes the toggle-joint 60, 64, to be broken and the moving contacts to be moved to the open position. Pivoting the handle 38 in the opposite direction brings about closing of the contacts 18, 20. When a fault is detected by the current transformer 72, a tripping circuit, which is advantageously electronic, controls unlocking of the latching device 56, in order to release the hook 52. Pivoting of the hook 52 ensures automatic opening of the contacts 18, 20.

Figure 3:
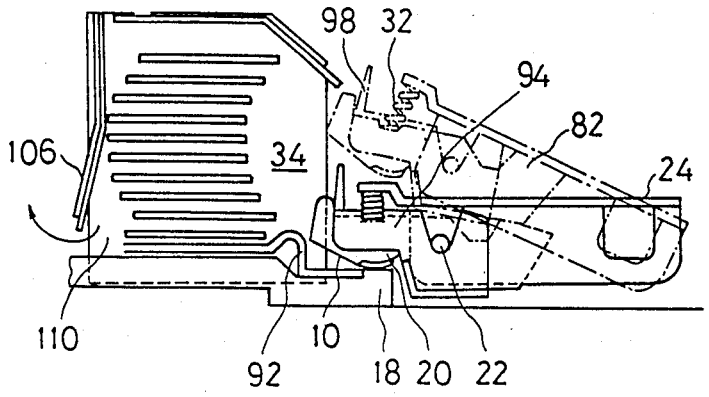
FIG. 3 is a partial view of FIG. 1 showing the breaking part of the circuit breaker respectively in the closed position and in the open position of the contacts, the latter position being represented by broken lines.
Figure 4:
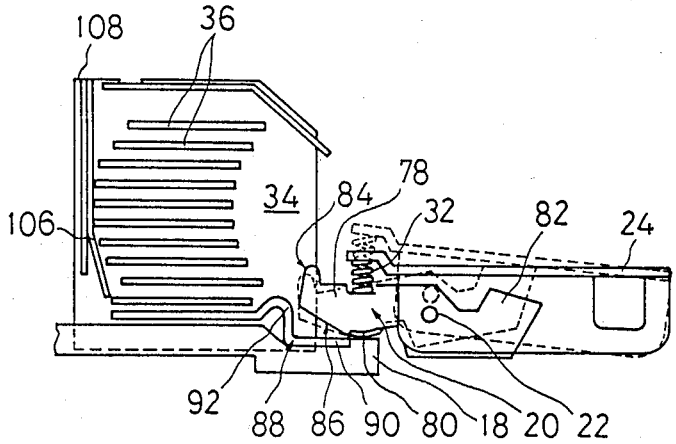
FIG. 4 is a similar view to that of FIG. 3 showing the contacts in the closed position and by the broken lines in an intermediate position at the moment the contacts separate, the insulating shield not being represented.

The circuit breaker comprises three poles, each housed in a compartment bounded by longitudinal partitions 74 of the moulded case. The three poles are identical and only one of them is described hereafter, referring more particularly to FIGS. 2 to 5. The spindle 22 of the support 24 has mounted on it with limited pivoting five contact arms 76, each made up of two blades 78 coupled and united, notably by a moving contact pad 80 soldered onto the longitudinal edge of the blades 78. The contact arms 76 are extended beyond the articulation spindle 22 by a heel 82 cooperating with the support 24 to limit the counterclockwise pivoting of the contact arms 76 in the figures, due to the action of the contact pressure spring 32. The contact pads 80 are fixed to a middle part of the blades 78 between the spindle 22 and the front end 84 of the blades 78. The front face 84 and the longitudinal edge 86 protruding beyond the moving contact pad 80 make up an arcing horn extending opposite a stationary arcing horn 88 associated with the stationary contact 18. The stationary contact 18 comprises a contact terminal common to the whole set of moving contacts 20 of the pole and the stationary arcing horn 88 is a plate extending between the stationary contact 18 and the arc chute 34, constituting one of the end plates thereof. The stationary arcing horn 88 presents in its part adjacent to the contact 18 a flat part 90 located in the plane of the stationary contact 18. The flat part 90 is extended by a part folded up into a hump 92 having an edge extending in the direction of movement of the moving contact 20. Referring to FIG. 4, it can be seen that in the separation position of the contacts 18, 20, represented by the broken lines, the moving arcing horn 86 forms with the flat part 90 of the stationary arcing horn 88 a divergent path oriented towards the arc chute 34. The folded part 92 of the stationary arcing horn 88 is a very short distance from the front edge 84 of the blades 78. The drawn arc, when the contacts 18, 20 separate, moves in the initial phase along the divergent paths 86, 90, and is then quickly anchored on the hump 92 and the facing edge 84. During this initial opening phase, lengthening of the arc is limited and it can be seen that as soon as the contacts 18, 20 separate, the clearance between the latter becomes greater than the clearance between the arcing horns 86, 88, notably at the level of the hump 92 and the front face 84 of the blades 78. Any arc return or rearcing on the contacts 18, 20 is thus avoided. When a continued opening movement of the moving contacts 20 occurs, the arc is stretched in front of the arc chute 34 into which it enters in the usual manner.

The moving contact 20 has associated with it a shield 94 made of a gas-producing insulating material. The shield 94 is made up of three parts, in this instance plates 96 inserted in the gaps separating the contact arms 76, a front part 98 forming an extension of the front face 84 of the blades 78 and a rear part 100 disposed at the level of the articulation spindle 22 of the contact arms 76. The shield 94 is fitted with slots 102 to clip onto the spindle 22, the shield 94 being securedly united with the moving contact 20 or affixed thereto with a small clearance. The plate 96 and contact arm 76 assembly forms with the front part 98 of the shield 94 a partition cooperating with a small clearance with ribs 104 provided on the side partition walls 74. This partition 96, 98 extends in the direction of movement of the moving contact 20 to the rear of the front face 84 of the blades 78. Similarly, the rear part 100 of the shield 94 cooperates with a small clearance with the side partition walls 74 and with the base 10 of the moulded case at the moment separation of the contacts 18, 20 occurs, to blank off the space located at the rear of the contacts 18, 20. The bottom edge 105 of the plates 96 extends appreciably parallel to the stationary contact 18 in the closed position of the contacts, set slightly back from the longitudinal edges of the blades 78, bearing the contact pads 80. Referring more particularly to FIG. 3, it can be seen that the contacts 18, 20, are housed in the closed position in a space constituting an arc formation chamber, bounded at the bottom by the stationary contact 18 and the wall 10, at the top by the blades 78 and the plates 96 fitted therebetween, and to the right in FIG. 3 by the part 100 of the shield 94. This arc formation chamber is open on the arc chute 34 side by a passage bounded by the hump 92 and the front part 98 of the shield 94. It can easily be seen that the volume of this arc formation chamber is small and that an arc drawn when separation of the contacts 18, 20 occurs causes the pressure inside the arc formation chamber to increase rapidly with a discharge of the gases towards the arc chute 34. This gas discharge blows the arc in the direction of the arc chute 34 forcing it to leave the contacts 18, 20 quickly. The gas-producing effect of the shield 94 contributes to this active arc blow-out.

The combined arc blow-out action, due to the insulating shield 94 and to the configuration of the arcing horns 86, 88, makes it possible to produce a circuit breaker with a high breaking capacity, having no arcing contacts. It is clear that the invention is applicable to a moving contact presenting a different number of contact arms 76, notably a single moving contact arm.

Referring more particularly now to FIGS. 3 and 4, it can be seen that the arc chute 34 is blanked off at the rear opposite the contacts 18, 20 by a plate or a pair of plates 106 made of insulating material which is advantageously gas-producing. The plate 106 is fixed by its upper edge 108 to the body of the arc chute 34 and presents a certain elasticity or a pivoting possibility so as to be able to move away from the ends of the plates 36 leaving clear a gas outlet passage 110 from the arc chute 34. When a low intensity current is broken, the arc chute 34 is blanked off by the plate 106 enabling the pressure to increase sufficiently to blow out the arc. When a high intensity current is broken, the pressure increase causes the plate 106 to be deflected allowing the gases to escape and the pressure in the arc chute 34 to be limited. The plate 106 acts as a deflector of the gases towards the base 10 of the moulded case, these gases subsequently escaping via orifices 112 disposed in the cover 12.

It is unnecessary to describe the operation of the circuit breaker as set forth in the foregoing explanation and the invention is naturally not limited to the embodiment more particularly described herein.

What we claim is:

1. A moulded case low voltage multipole circuit breaker having a base and several internal compartments arranged side by side, each one associated with one of the poles and insulating partitions separating said compartments, each pole comprising:

a plurality of stationary contacts secured to the base of said moulded case and a plurality of moving contacts, able to occupy an opening and a closing position, in which the moving contacts cooperate with the stationary contacts, the set of said contacts being aligned in a row, moving contact arms in the form of elongated blades having longitudinal edges and a front edge, said blades extending parallel with a small clearance from one another, and the moving contacts being fixed to one of said longitudinal edges, a moving contact arm support, in the form of a cage and a spindle borne by said support, said contact arms being mounted with limited pivoting on said spindle which extends perpendicular to the blades forming the moving contact arms, a shaft on which said moving contact arm support is mounted with limited pivoting, an operating mechanism actuating said moving contact arm support to move said moving contacts to the opening position and to the closing position, an arc formation chamber having two lateral faces, constituted by the insulating partitions separating the poles, a lower face constituted by said base, a front face and a rear face, said stationary and moving contacts being disposed in the closing position in said formation chamber, with the stationary contacts on the lower face side and the moving contacts on the upper face side, an arc chute with deionization plates, disposed to the rear face side of the arc formation chamber to pick up the arc drawn into the formation chamber, when separation of the contacts occurs, an insulating shield associated with said moving contact arms having a part inserted to blank off the gaps between the contact arms and the gaps between the insulating partitions and the contact arms, a rear part blanking off the front face of the arc formation chamber in the closing position of the contacts, said rear part being disposed in front of the contacts on the opposite side from the arc chute, a stationary arcing horn extending between the stationary contacts and the arc chute along the lower face of the arc formation chamber and having a folded part extending in the direction of movement of the moving contacts facing the front edge of the moving contacts.

2. The circuit breaker according to claim 1, wherein a moving arcing horn is borne by the edge of the moving contact arms forming an extension of the latter in the direction of the arc chute, said arcing horns diverging in the direction of the arc chute to lengthen the arc, the maximum clearance of said arcing horns being greater than the clearance of said folded part from said front edge in the closing position.

3. The circuit breaker according to claim 2, wherein the folded part of the stationary arcing horn extends at the moment separation of the contacts occurs parallel to the front edges of the contact arms in the form of blades at a sufficiently small distance to avoid any rearcing on the contacts.

4. The circuit breaker according to claim 1, wherein the insulating shield is mounted with limited pivoting on the pivoting spindle of the contact arms to accompany the latter in their limited movement, in relation to the support, at the beginning of the circuit breaker opening phase, and to improve blanking-off of the arc formation chamber.

5. The circuit breaker according to claim 1, having a current conductor running flat along the base of the moulded case and bearing said stationary contacts, the moving contact arms in the form of parallel blades being appreciably aligned with said conductor in the closing position and the edges of the blades bearing the moving contacts extending parallel at a small distance from said base, said insulating shield cooperating with said base to blank off the arc formation chamber at the moment separation of the contacts occurs, and the arc chute located on the said conductor side comprising plates parallel to said base and an inlet opening facing the moving contacts.

6. The circuit breaker according to claim 5, wherein the arc chute comprises on the opposite side from said inlet opening, a gas outlet opening and a valve partially blanking off said opening, arranged as a deflector of the gases towards said base, said valve leaving the opening clear when the internal pressure rises.

7. The circuit breaker according to claim 6, wherein said valve is constituted by an insulating plate made of a gas-producing material, having a fixing edge located away from the base, said valve being elastically biased towards the blanking position.

* * * * *